US005904300A

United States Patent [19]

Augustin

[11] Patent Number: 5,904,300

[45] Date of Patent: May 18, 1999

[54] FUEL INJECTOR

[75] Inventor: Ulrich Augustin, Kernen, Germany

[73] Assignee: Daimler-Benz AG, Stuttgart, Germany

[21] Appl. No.: 08/969,499

[22] Filed: Nov. 13, 1997

[30] Foreign Application Priority Data

Nov. 15, 1996 [DE] Germany ..... 196 47 304

[51] Int. Cl.[6] ..... F02M 47/02

[52] U.S. Cl. ..... 239/533.8; 239/533.2; 239/533.3; 239/585.1

[58] Field of Search ..... 239/89, 88, 585.1, 239/533.2, 533.3, 533.8, 533.9, 533.11

[56] References Cited

U.S. PATENT DOCUMENTS

| | | | |
|---|---|---|---|
| 2,556,369 | 6/1951 | Hogeman | 239/533.8 |
| 4,047,664 | 9/1977 | Kranc et al. | 239/533.9 |
| 4,674,688 | 6/1987 | Kanesaka | 239/533.8 |
| 5,531,382 | 7/1996 | Buckley et al. | 239/533.9 |
| 5,551,634 | 9/1996 | Raab et al. | 239/533.3 |
| 5,718,385 | 2/1998 | Fontell | 239/533.9 |
| 5,826,801 | 10/1998 | Kobayashi et al. | 239/533.4 |

FOREIGN PATENT DOCUMENTS

| | | |
|---|---|---|
| 0 678 668 | 10/1995 | European Pat. Off. . |
| 2 043 777 | 10/1980 | United Kingdom . |

*Primary Examiner*—Andres Kashnikow
*Assistant Examiner*—David Deal
*Attorney, Agent, or Firm*—Klaus J. Bach

[57] ABSTRACT

In a fuel injector for a fuel injection system of an internal combustion engine including an injector housing with an injection nozzle controlled by a valve needle extending through a cylindrical fuel pressure space from which fuel under pressure is supplied to the fuel injection nozzle, the fuel pressure space includes a flow limiting piston with a seating surface at its end adjacent the needle tip and the injector housing has a valve seat disposed opposite the piston seating surface for blocking fuel flow to the injector nozzle when the flow limiting piston is seated on the valve seat and the flow limiting piston is spring-biased away from the valve seat with a force which is sufficient to normally hold the flow limiting piston away from the valve seat, but which permits closing of the valve when the fuel flow to the injector nozzle becomes excessive.

5 Claims, 1 Drawing Sheet

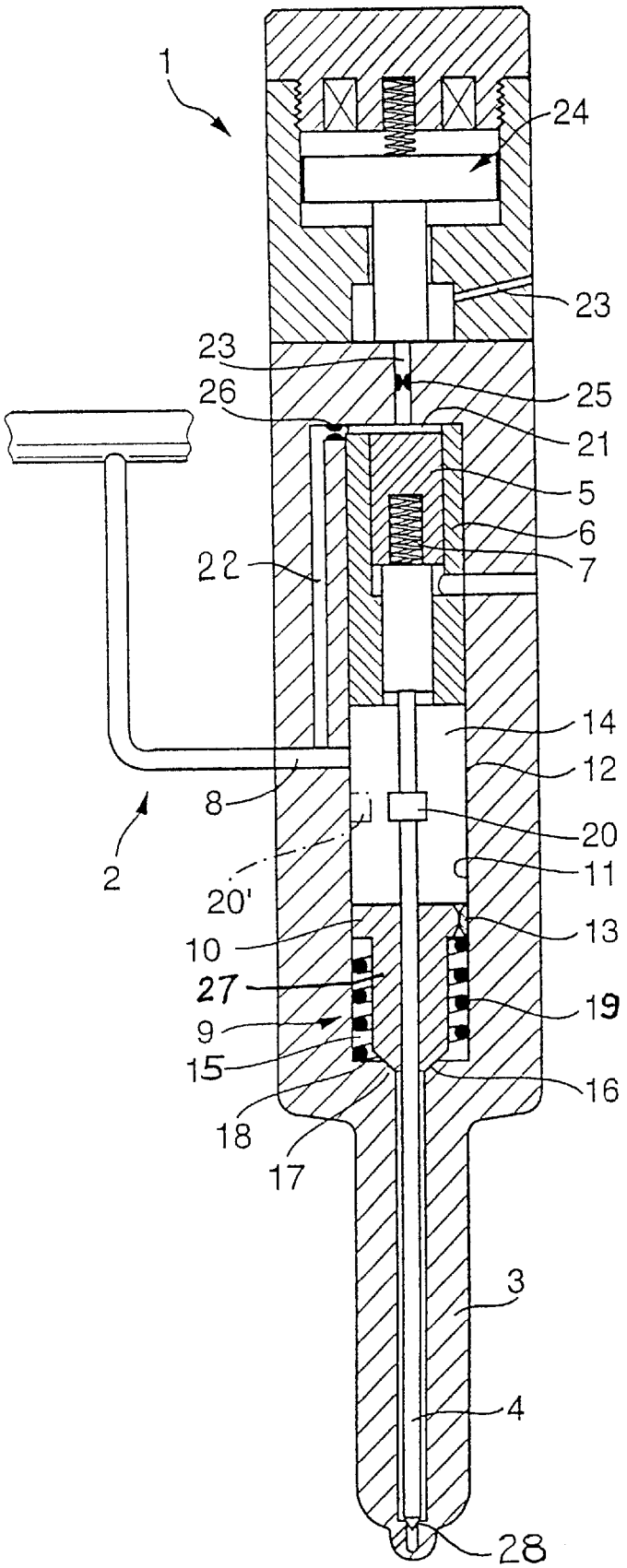
1
24
23
23
25
26
21
5
6
7
22
14
12
8
20
2
11
20'
13
10
27
19
9
15
16
18
17
3
4
28

FUEL INJECTOR

BACKGROUND OF THE INVENTION

The invention relates to a fuel injector for a fuel injection system of an internal combustion engine with a high pressure pump for supplying fuel under pressure, by way of a fuel supply line, to at least one injector including an injection nozzle with a valve needle. The injector is electrically controllable and includes a pressure relieve passage leading to a low pressure fuel return line and a flow limiter for limiting the maximum fuel flow volume.

A fuel injection system with a high pressure fuel pump is disclosed for example in EP 0 678 602 A2. In this system, the high pressure pump supplies the fuel, by way of a fuel supply line, to a commom rail distribution pipe, which serves as a high pressure fuel storage structure for supplying fuel to all the magnetic valve-controlled injectors of the internal combustion engine.

The fuel injection system includes flow volume limiting valves arranged in injection lines extending between the injectors and the common rail pipe. The flow volume limiting valves are adapted to limit the fuel flow to the injectors so as to prevent excessive flow rates as they may occur for example when a valve needle gets stuck or a valve needle breaks or a high pressure line becomes defective.

With such measures, the properly operating valves and the non-defective fuel lines can still be operated so that at least an emergency operation of the engine can be maintained.

It is the object of the present invention to provide a fuel injection system of the type referred to above with a fuel flow limiting valve, wherein the fuel volume contained in the system between the valve needle seat and the flow volume limiting valve is minimized.

SUMMARY OF THE INVENTION

In a fuel injector for a fuel injection system of an internal combustion engine including an injector housing with an injection nozzle controlled by a valve needle extending through a cylindrical fuel pressure space from which fuel under pressure is supplied to the fuel injection nozzle, the fuel pressure space includes a flow limiting piston with a seating surface at its end adjacent the needle tip and the injector housing has a valve seat disposed opposite the piston seating surface for blocking fuel flow to the injector nozzle when the flow limiting piston is seated on the valve seat and the flow limiting piston is spring-biased away from the valve seat with a force which is sufficient to normally hold the flow limiting piston away from the valve seat, but which permits closing of the valve when the fuel flow to the injector nozzle becomes excessive.

With the particular arrangement of the flow limiting piston which serves as a controlled flow limiting device, the fuel volume downstream of the flow limiting valve is minimal. As a result, only the small amount of fuel enclosed in the area between the flow limiting valve and the needle seat of the valve needle is suddenly released if for example the nozzle end cap breaks. Consquently no engine damage will occur since the fuel volume released is only minimal. In addition, the flow volume limit can be controlled more accurately since leakages occuring upstream of the flow volume limiting valve, that is at the valve needle shaft or at the control or closing piston, are discharged by way of the throttle means which is in communication withe the low pressure side of the fuel system.

GB 2 043 777A discloses a fuel injection system with a spring-loaded compensation piston which includes a throttling nozzle which however provides always for a high pressure communication path to the valve needle. The compensation piston can be operated by a valve lift control, the piston is in communication with a valve control structure and serves a control member for the accurate metering of the fuel amount to be injected.

In the known fuel injection systems with fuel flow limiting valves between the common rail pipe and the respective magnetic valve controlled injectors, the engine is not protected from excess speeds, because excessive fuel amounts could be injected upon breakage of an injection nozzle end cap.

The invention will be described below on the basis of the accompanying drawing.

BRIEF DESCRIPTION OF THE DRAWINGS

The sole FIGURE is a cross-sectional view of a fuel injector including a magnetic valve fuel injection control structure.

DESCRIPTION OF A PREFERRED EMBODIMENT

A magnetic valve controlled fuel injection nozzle 1 for a fuel injection system of a multi-cylinder internal combustion engine using a common rail arrangement comprises essentially an elongated valve needle 4 supported in a nozzle body 3, a control piston or, respectively, closing piston 5 which is disposed at the rear end of the valve needle 4 in engagement with the nozzle needle and which is slideably supported in a housing 6 at one end of a cylindrical cavity 12 so as to be axially movable in the nozzle body 3. The piston is movable against the force of a spring 7. A fuel supply line 8 is connected to the injection nozzle 1. A fuel flow limiting valve 9 is disposed at the other end of the cylindrical cavity 12.

The fuel flow limiting valve 9 includes a limit piston 27 through which the valve needle 4 extends and which guides the valve needle 4. The piston 27 has at its upper end a circumferential flange 10, which slides along the inner wall 11 of the cylindrical cavity 12.

The circumferential flange 10 includes a throttle passage 13 with a predetermined flow cross-section, which represents the only communication passage between an upper pressure space 14 above the piston 27 to which the fuel supply line 8 is connected and a lowe pressure space 15 formed downstream between the circumferential flange 10 and the needle valve seat 28 of the valve needle 4.

The limit piston 27 has a truncated cone portion at its end axially opposite the flange 10 which co-operates with a correspondingly shaped conical seating surface 16 of the valve seat 17 in the nozzle body 3. Between the circumferential flange 10 and a support shoulder 18 of the nozzle body 3 adjacent the seating surface 16, a compression spring 19 is disposed, which biases the limit piston 27 toward a step which may be a flange member 20 formed on the valve needle 4 or a projection 20' projecting from the wall 11 of the cylindrical cavity 12 of the nozzle body.

The closing piston 5 delimits a control space 21 to which a fuel supply passage 22 extends which branches off the fuel supply line 8. A fuel release passage 23 extends from the control space 21, which can be placed in communication with the low pressure side (not shown) by way of an electromagnetically operable control valve 24, that is, respectively, a magnet valve. The fuel release passage 23 includes a throttling structure 25 arranged upstream of the control valve 24 and the fuel supply passage includes a throttling structure 26.

Operation of the flow volume limiting valve, that is, respectively, the limit piston 27.

The flow limiting piston 27 moves, during each injection, against the force of the spring 19 toward the nozzle tip. However, during normal operation, the limit piston 27 will not reach the seat 16. As a result, flow communication between the fuel pressure chamber 12 and the nozzle opening is not interrupted. During the injection interruption, the limit piston 27 is returned to its stop 20 or 20' by the compression spring 18. However, if a predetermined injection volume, which is in excess of the normal operating volume is exceeded the limit piston 27 is engaged with the valve seat 17, whereby the flow connection is interrupted and the engine is protected from excess fuel injection.

What is claimed is:

1. A fuel injector for a fuel injection system of an internal combustion engine adapted to receive fuel under pressure from a high pressure fuel supply system, said injector including a nozzle housing with an injector nozzle needle with a tip axially movably disposed therein for controlling fuel flow through an injection nozzle at one end of said nozzle housing, said nozzle housing including a cylindrical cavity through which said nozzle needle extends for controlling, with its tip, fuel flow out of said nozzle housing, said cylindrical cavity forming a pressure chamber in communication with a pressurized fuel line for receiving fuel under pressure therefrom, said cylindrical cavity including a fuel flow limiting piston having a front end with a valve seating surface disposed opposite a valve seat arranged at an end of said pressure chamber for blocking fuel flow passage to said needle tip, a spring engaging said limiting piston so as to bias it away from said valve seat and a stop arranged in said pressure chamber to limit the movement of said piston away from said valve seat.

2. A fuel injector according to claim 1, wherein said stop is a flange formed on the nozzle needle.

3. A fuel injector according to claim 1, wherein said stop is a projection extending in to said pressure chamber from the cylindrical wall thereof.

4. A fuel injector according to claim 1, wherein said limit piston has at its end remote from said nozzle tip a flange and said compression spring is disposed between said flange and an end face of said pressure chamber around said valve seat.

5. A fuel injector according to claim 4, wherein said limit piston is conical at its end adjacent said valve seat and said valve seat is correspondingly conical for sealingly seating said limit piston.

* * * * *